US008725049B2

(12) United States Patent
Maruyama

(10) Patent No.: US 8,725,049 B2
(45) Date of Patent: May 13, 2014

(54) FIXING DEVICE HAVING NIP PLATE WITH SURFACE INCLUDING HIGH ABSORPTION REGION

(75) Inventor: Yasuhiro Maruyama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 255 days.

(21) Appl. No.: 13/041,090

(22) Filed: Mar. 4, 2011

(65) Prior Publication Data

US 2011/0236088 A1 Sep. 29, 2011

(30) Foreign Application Priority Data

Mar. 25, 2010 (JP) ..... 2010-069338

(51) Int. Cl.
*G03G 15/20* (2006.01)

(52) U.S. Cl.
USPC ..... 399/329

(58) Field of Classification Search
USPC ..... 399/122, 320, 328, 329
See application file for complete search history.

(56) References Cited

U.S. PATENT DOCUMENTS

| | | | | |
|---|---|---|---|---|
| 7,511,249 | B2 * | 3/2009 | Begeal et al. | 219/216 |
| 8,010,028 | B2 * | 8/2011 | Shinshi | 399/329 |
| 2007/0292175 | A1 | 12/2007 | Shinshi | |
| 2008/0138131 | A1 * | 6/2008 | Jung et al. | 399/329 |
| 2009/0208264 | A1 * | 8/2009 | Fujiwara et al. | 399/329 |

FOREIGN PATENT DOCUMENTS

| | | | | |
|---|---|---|---|---|
| JP | 08234618 A | * | 9/1996 | G03G 15/20 |
| JP | H08-234618 A | | 9/1996 | |
| JP | 2002108119 A | | 4/2002 | |
| JP | 2007-171318 A | | 7/2007 | |
| JP | 2007-334205 A | | 12/2007 | |
| JP | 2008129092 A | | 6/2008 | |
| JP | 2008-233886 | | 10/2008 | |

OTHER PUBLICATIONS

JP Office Action dtd Jan. 10, 2012, JP Appln. 2010-069338, English translation.
JP Office Action dtd May 15, 2012, JP Appln. 2010-069338, English Translation.

* cited by examiner

*Primary Examiner* — David Gray
*Assistant Examiner* — Carla Therrien
(74) *Attorney, Agent, or Firm* — Banner & Witcoff, Ltd.

(57) ABSTRACT

A fixing device for thermally fixing a developing agent image to a sheet includes: a tubular flexible fusing member; a heater; a nip member; and a backup member. The tubular flexible fusing member has an inner peripheral surface defining an internal space. The heater is disposed in the internal space and radiates radiant heat. The nip member is disposed in the internal space and receives the radiant heat from the heater. The inner peripheral surface is in sliding contact with the nip member. The backup member provides a nip region in cooperation with the fusing member upon nipping the fusing member between the backup member and the nip member. The nip member has a surface confronting the heater. The surface includes a first heat absorption region having a first heat absorption ratio of a predetermined value and a second heat absorption region having a second heat absorption ratio higher than the first heat absorption ratio. The second heat absorption region is positioned at a region of the surface overlapping with the nip region.

10 Claims, 9 Drawing Sheets

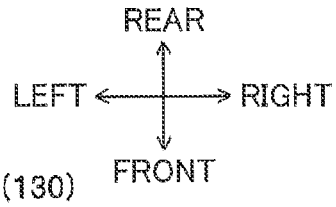
FIG.8A
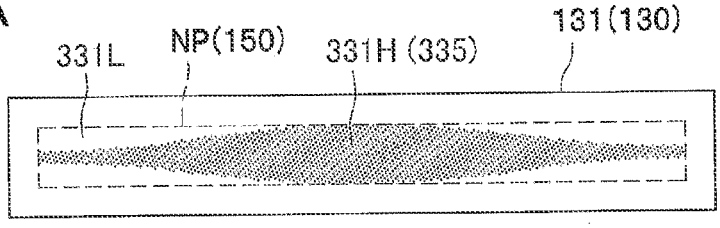
FIG.8B
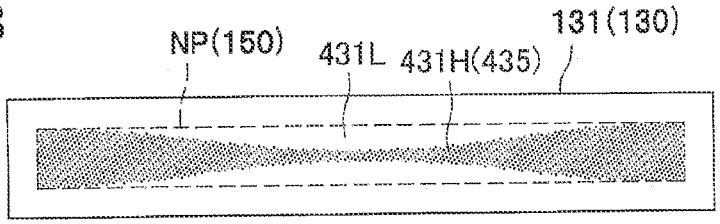
FIG.8C
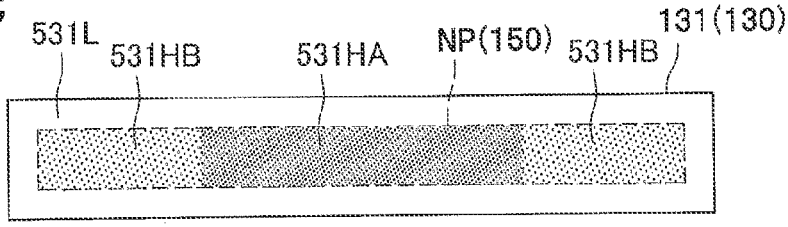
FIG.8D
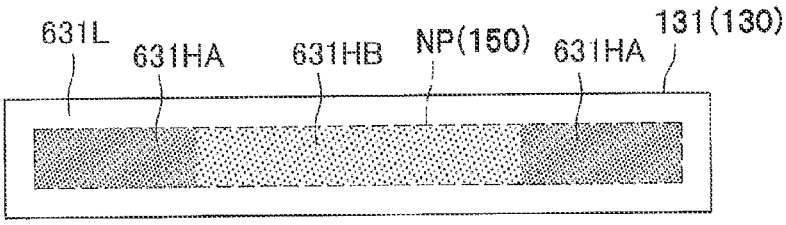
FIG.8E
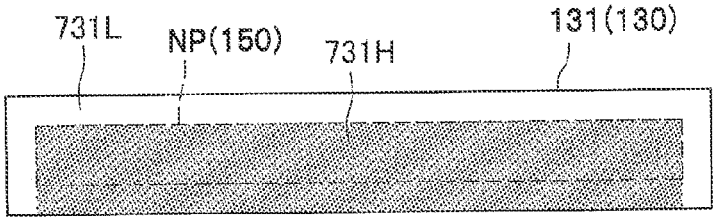

FIXING DEVICE HAVING NIP PLATE WITH SURFACE INCLUDING HIGH ABSORPTION REGION

CROSS REFERENCE TO RELATED APPLICATION

This application claims priority from Japanese Patent Application No. 2010-069338 filed Mar. 25, 2010. The entire content of the priority application is incorporated herein by reference.

TECHNICAL FIELD

The present invention relates to a fixing device that thermally fixes a transferred developing agent image to a sheet.

BACKGROUND

A conventional thermal fixing device for an electro-photographic type image forming device includes a tubular fusing film, a heater disposed in an internal space of the fusing film, a pressure roller, and a nip plate defining a nip region in cooperation with the pressure roller through the fusing film. While a sheet of paper (a recording sheet) is conveyed in the nip region, a developing agent image on the recording sheet is thermally fixed.

SUMMARY

In such a fixing device, in general, the heater heats the nip plate to rise a temperature of the nip plate to a suitable temperature for thermally fixing the developing agent onto the sheet. In order to promptly and efficiently heat the developing agent, a reflection member is adapted to reflect radiant heat from the heater toward the nip plate, and a surface of the nip plate confronting the heater is entirely painted with a black color. Hence, radiant heat from the heater is concentrated onto the nip plate.

However, when the entire surface of the nip plate confronting the heater is painted with a black color, a portion of the nip plate other than a portion thereof overlapping with the nip region is also heated. This does not result in efficient heating of the developing agent. In view of the foregoing, it is an object of the present invention to provide a fixing device capable of optimizing a temperature of a developing agent.

In order to attain the above and other objects, the present invention provides a fixing device for thermally fixing a developing agent image to a sheet fed in a sheet feeding direction including a tubular flexible fusing member; a heater; a nip member; and a backup member. The tubular flexible fusing member has an inner peripheral surface defining an internal space and defines an axial direction. The heater is disposed in the internal space and configured to radiate radiant heat. The nip member is disposed in the internal space and configured to receive the radiant heat from the heater. The inner peripheral surface is in sliding contact with the nip member. The backup member is configured to provide a nip region in cooperation with the fusing member upon nipping the fusing member between the backup member and the nip member. The nip member has a surface confronting the heater. The surface includes a first heat absorption region having a first heat absorption ratio of a predetermined value and a second heat absorption region having a second heat absorption ratio higher than the first heat absorption ratio. The second heat absorption region is positioned at a region of the surface overlapping with the nip region.

BRIEF DESCRIPTION OF THE DRAWINGS

In the drawings:

FIGS. 8A to 8E are plan views of the nip plate, each showing a position of a layer of paint as a modification;

DETAILED DESCRIPTION

Figure 1:
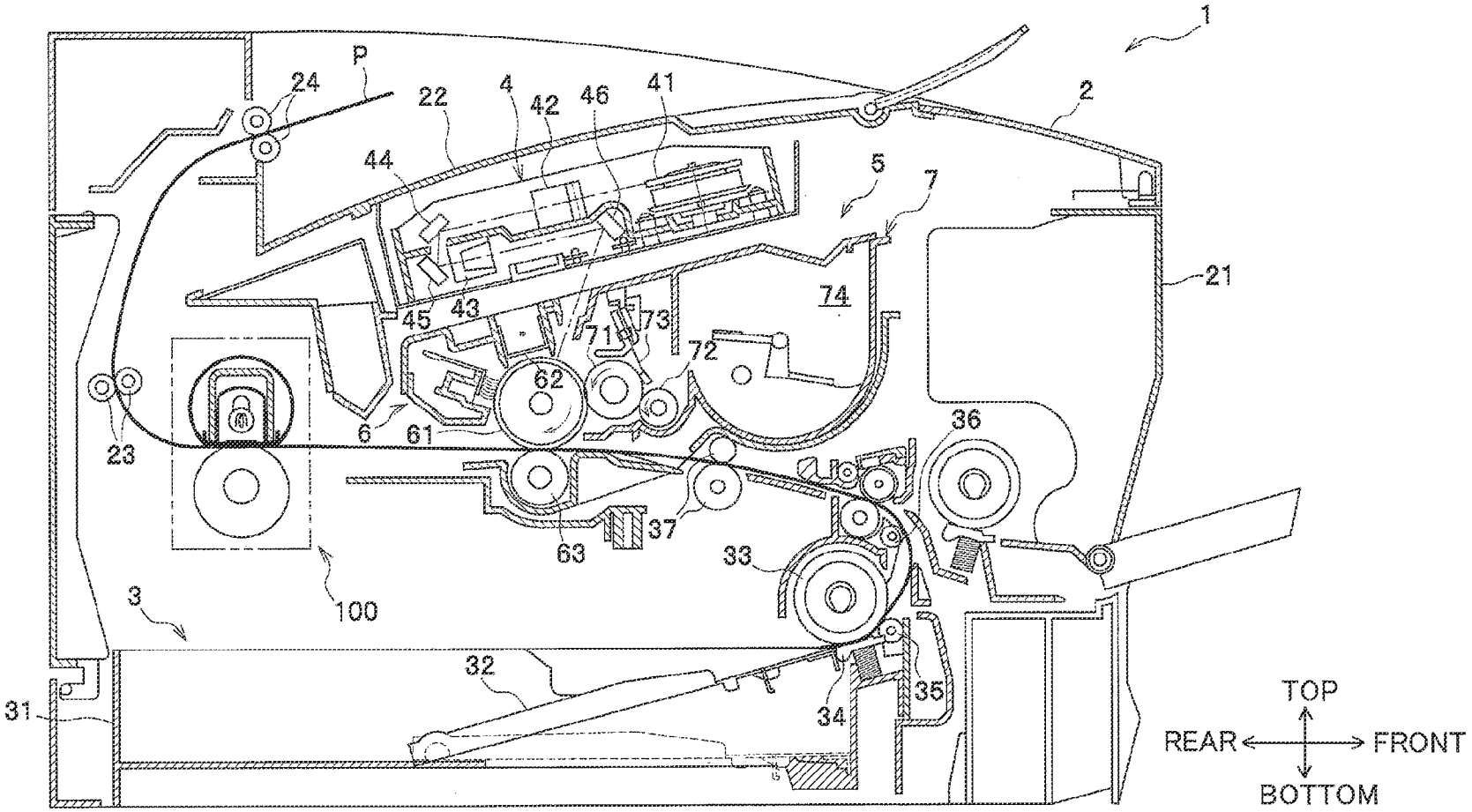
FIG. 1 is a schematic cross-sectional view showing a structure of a laser printer having a fixing device according to a first embodiment of the present invention.

Next, a general structure of a laser printer as an image forming device will be described with reference to FIG. 1. The laser printer 1 shown in FIG. 1 is provided with a fixing device 100 according to a first embodiment of the present invention. A detailed structure of the fixing device 100 will be described later while referring to FIGS. 2 to 5.

<General Structure of Laser Printer>

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a rotatably driven polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
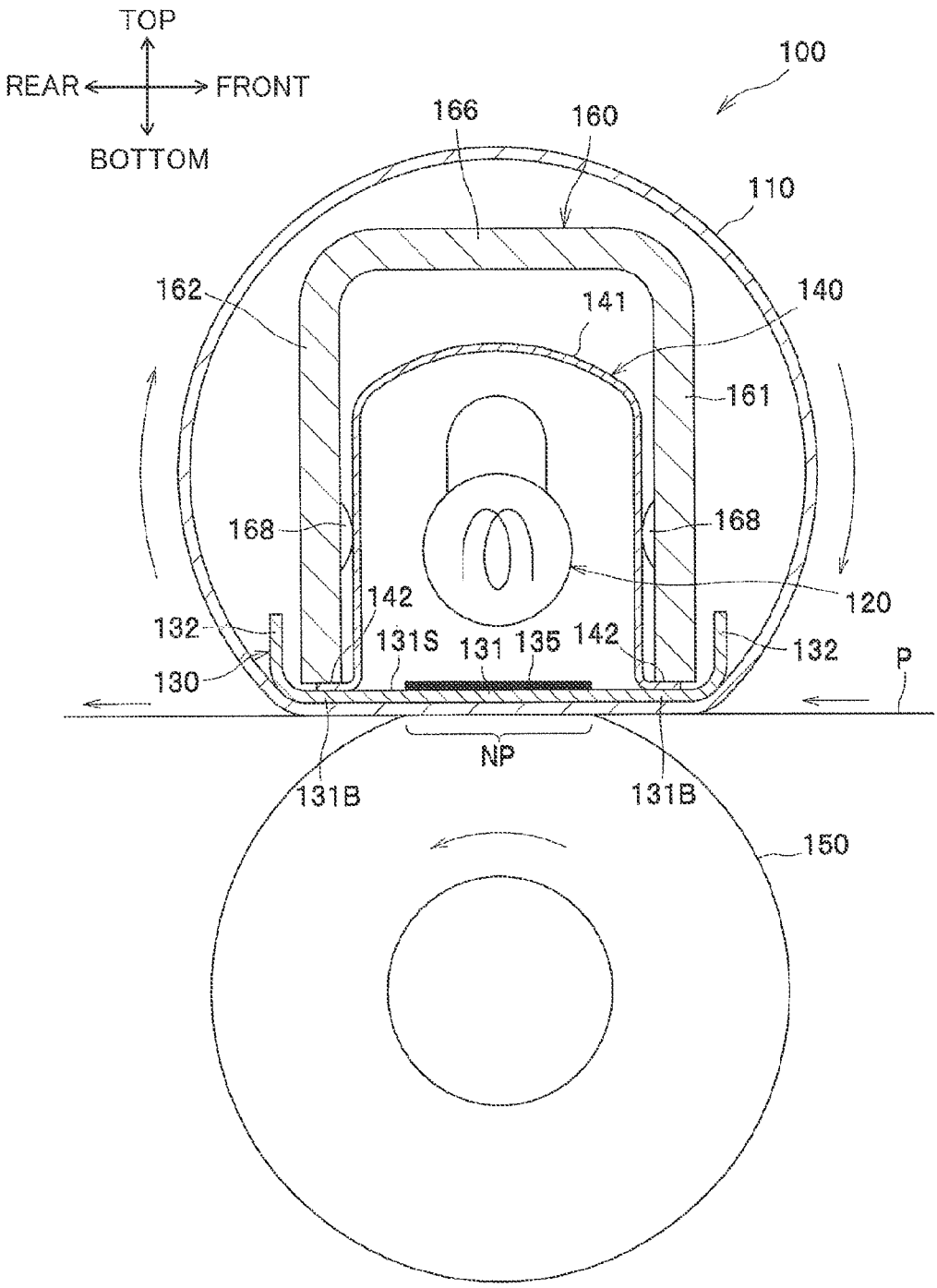
FIG. 2 is a schematic cross-sectional view showing a structure of the fixing device according to the first embodiment.

As shown in FIG. 2, the fixing device 100 according to the first embodiment of the present invention includes a flexible tubular fusing member such as a tube or film 110, a halogen lamp 120, a nip plate 130 as a nip member, a reflection plate 140, a pressure roller 150 as a backup member, and a stay 160.

The fusing film 110 is of a tubular configuration having heat resistivity and flexibility. Each widthwise (right and left) end portion of the fusing film 110 is guided by a guide member (not shown) fixed to a frame of the fixing device 100 so that the fusing film 110 is circularly movable. Further, the guide member restrains the fusing film 110 from moving in a rightward/leftward direction (in an axial direction of the fusing film 110).

The halogen lamp 120 is a heater configured to radiate radiant heat to heat the nip plate 130 and the fusing film 110 for heating toner on the sheet P. The halogen lamp 120 is positioned at an internal space of the fusing film 110 and is spaced away from an inner peripheral surface of the fusing film 110 as well as from an upper surface 131S of the nip plate 130 by a predetermined distance.

Figure 3:
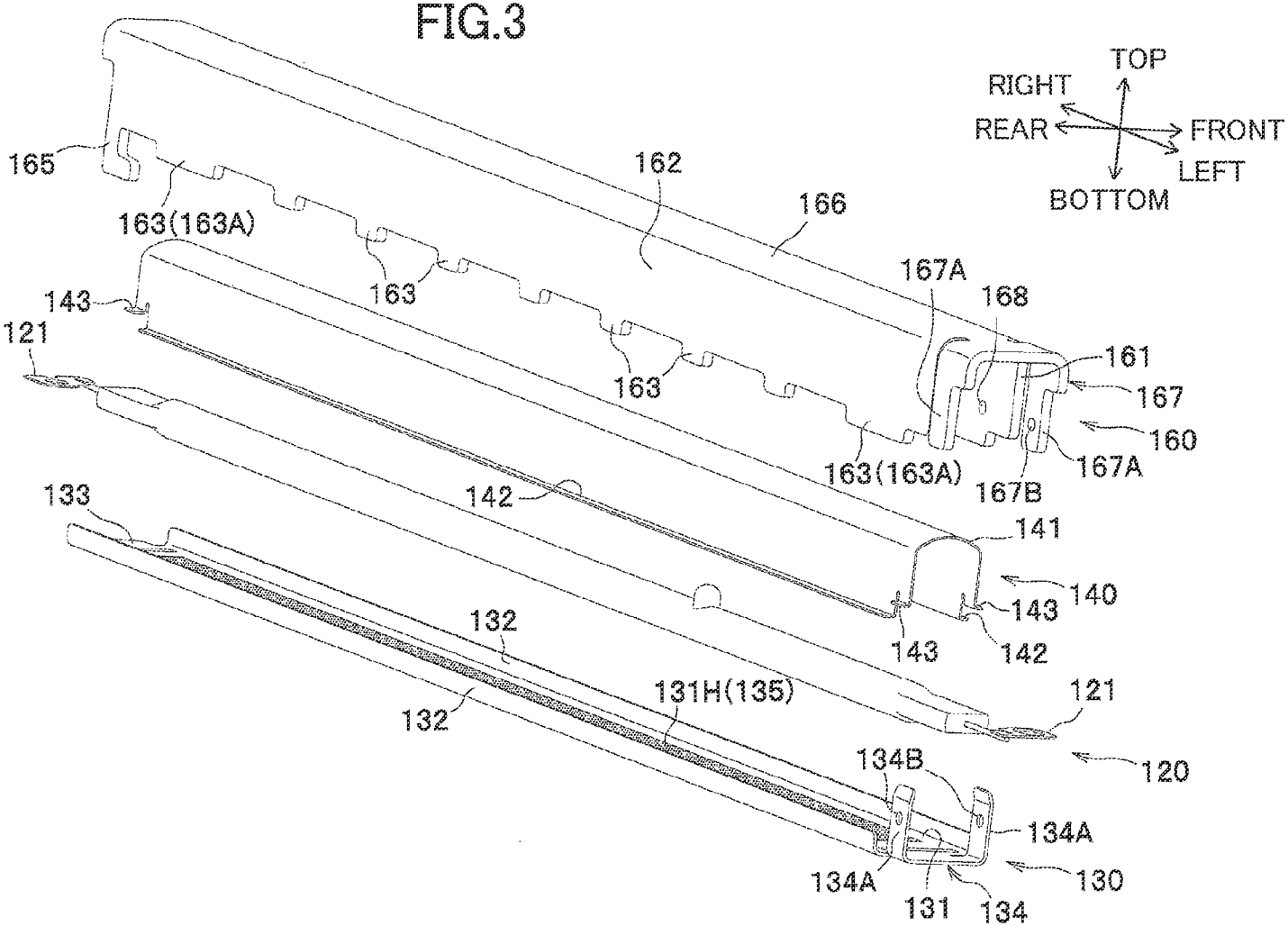
FIG. 3 is an exploded perspective view showing a halogen lamp, a nip plate, a reflection plate, and a stay according to the first embodiment.

The halogen lamp 120 has right and left end portions, and each end portion is provided with a planar terminal 121 (FIG. 3). The terminal 121 is electrically connected to a power source (not shown) provided within the main frame 2 of the laser printer 1 via a flexible line.

The nip plate 130 is adapted for receiving pressure from the pressure roller 150 and for receiving radiant heat from the halogen lamp 120. The nip plate 130 transmits radiant heat from the halogen lamp 120 to the toner on the sheet P through the fusing film 110. To this effect, the nip plate 130 is positioned such that the inner peripheral surface of the fusing film 110 is moved slidably therewith through grease. The nip plate 130 may be in direct contact with the fusing film 110 without grease therebetween.

The nip plate 130 has a generally U-shaped cross-section made from a material such as aluminum having a thermal conductivity higher than that of the stay 160 (described later) made of steel. More specifically, for fabricating the nip plate 130, an aluminum plate is bent into U-shape to provide a base portion 131 extending in a frontward/rearward direction and upwardly folded portions 132 (that is oriented in a direction from the pressure roller 150 to the nip plate 130). The base portion 131 has end portions 131B in the frontward/rearward direction.

As shown in FIG. 3, the nip plate 130 has a right end portion provided with an insertion portion 133 extending flat, and a left end portion provided with an engagement portion 134. The engagement portion 134 has U-shaped configuration as viewed from a left side including side wall portions 134A extending upward and formed with engagement holes 134B.

The nip plate 130 has a surface confronting the halogen lamp 120, that is, the upper surface 131S of the base portion 131. The upper surface 131S has a region painted with a black color (a layer of paint 135).

The reflection plate 140 is adapted to reflect radiant heat radiating in the frontward/rearward direction and in an upper direction from the halogen lamp 120 toward the nip plate 130 (toward the upper surface 131S of the base portion 131). As shown in FIG. 2, the reflection plate 140 is positioned within the fusing film 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and a flange portion 142 extending outward from each end portion of the reflection portion 141 in the frontward/rearward direction. A mirror surface finishing is available on the surface of the aluminum reflection plate 140 for specular reflection in order to enhance heat reflection ratio. As shown in FIG. 3, two engagement sections 143 are provided at each widthwise (right and left) end of the reflection plate 140. Each engagement section 143 is positioned higher than the flange portion 142.

As shown in FIG. 2, the pressure roller 150 is positioned below the nip plate 130. The pressure roller 150 is made from a resiliently deformable material. The pressure roller 150 is resiliently deformed to nip the fusing film 110 in cooperation with the nip plate 130 to provide a nip region NP for nipping the sheet P between the pressure roller 150 and the fusing film 110. In other words, the pressure roller 150 presses the nip plate 130 through the fusing film 110 for providing the nip region NP between the pressure roller 150 and the fusing film 110.

The pressure roller 150 is rotationally driven by a drive motor (not shown) disposed in the main frame 2. By the rotation of the pressure roller 150, the fusing film 110 is circularly moved along the nip plate 130 because of a friction force generated therebetween or between the sheet P and the fusing film 110. A toner image on the sheet P can be thermally fixed thereto by heat and pressure during passage of the sheet P at the nip region NP between the pressure roller 150 and the fusing film 110.

The stay 160 is adapted to support the end portions 131B of the nip plate 130 through the flange portion 142 of the reflection plate 140 for maintaining rigidity of the nip plate 130. The stay 160 has a U-shape configuration in conformity with the outer shape of the reflection portion 141 covering the reflection plate 140. For fabricating the stay 160, a highly rigid member such as a steel plate is folded into U-shape to have a top wall 166, a front wall 161 and a rear wall 162. As shown in FIG. 3, each of the front wall 161 and the rear wall 162 has a lower end portion provided with comb-like contact portions 163.

As a result of assembly of the nip plate 130 together with the reflection plate 140 and the stay 160, the comb-like contact portions 163 are nipped between the right and left engagement sections 143. That is, the right engagement section 143 is in contact with the rightmost contact portion 163A, and the left engagement section 143 is in contact with the leftmost contact portion 163A. As a result, displacement of the reflection plate 140 in a rightward/leftward direction (widthwise direction/axial direction) due to vibration caused by operation of the fixing device 100 can be restrained by the engagement between the engagement sections 143 and the comb-like contact portions 163A.

The front and rear walls 161, 162 have right end portions provided with L-shaped engagement legs 165 each extending downward and then leftward. The insertion portion 133 of the nip plate 130 is insertable into a space between the confronting engagement legs 165. Further, each end portion 131B of the base portion 131 is abuttable on each engagement leg 165 as a result of the insertion.

The top wall 166 has a left end portion provided with a retainer 167 having U-shaped configuration. The retainer 167 has a pair of retaining walls 167A whose inner surfaces are provided with engagement bosses 167B each being engageable with each engagement hole 134B.

As shown in FIGS. 2 and 3, each widthwise (left and right) end portion of each of the front wall 161 and the rear wall 162 has an inner surface provided with two abutment bosses 168 protruding inward in abutment with the reflection portion 141 in the frontward/rearward direction. Therefore, displacement of the reflection plate 140 in the frontward/rearward direction due to vibration caused by operation of the fixing device 100 can be restrained because of the abutment of the reflection portion 141 with the bosses 168.

Assembling procedure of the reflection plate 140 and the nip plate 130 to the stay 160 will be described. First, the reflection plate 140 is temporarily assembled to the stay 160 by the abutment of the outer surface of the reflection portion 141 on the abutment bosses 168. In this case, the engagement sections 143 are in contact with the widthwise endmost contact portions 163A.

Figure 4:
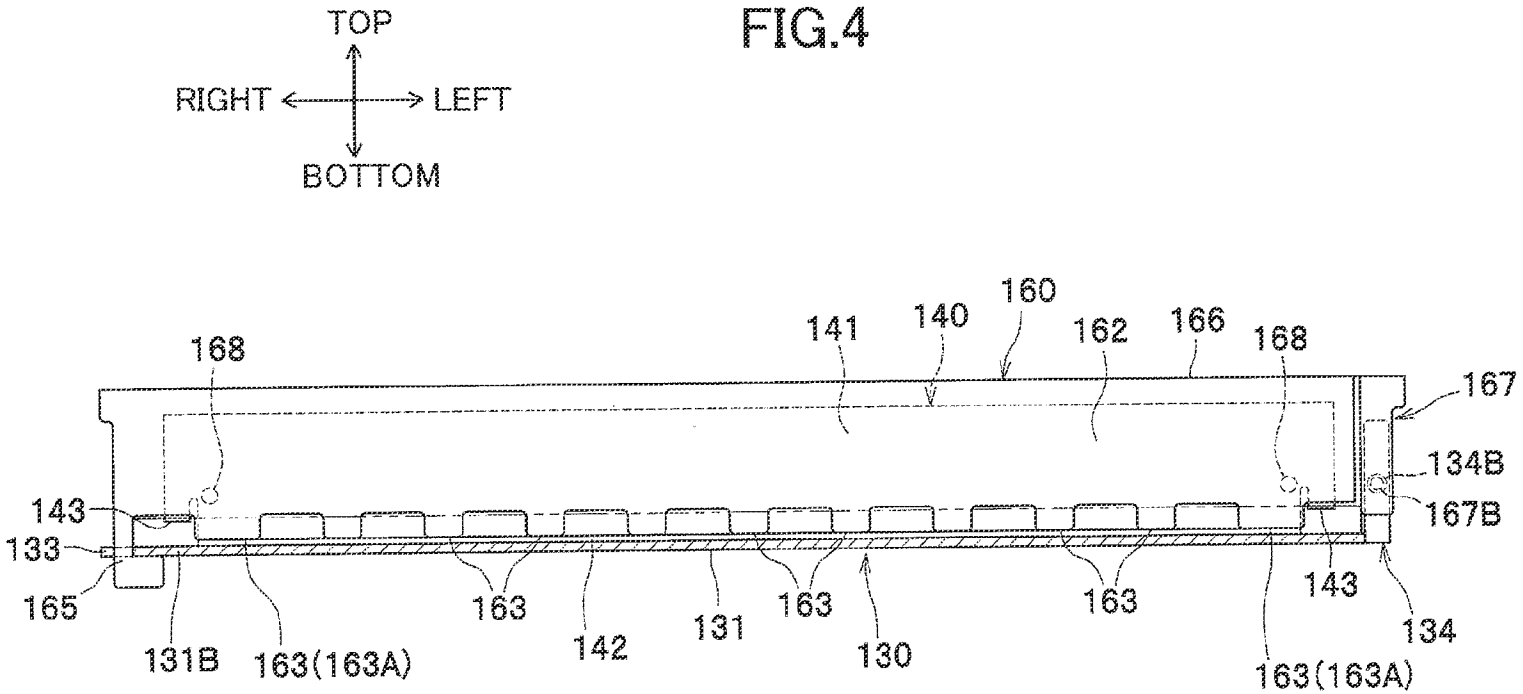
FIG. 4 is a rear view showing an assembled state of the nip plate, the reflection plate and the stay according to the first embodiment.

Then, as shown in FIG. 4, the insertion portion 133 is inserted between the engagement legs 165 and 165, so that the base portion 131 can be brought into engagement with the engagement legs 165. Thereafter, the engagement bosses 167B are engaged with the engagement holes 134B. By this engagement, each flange portion 142 is sandwiched between the nip plate 130 and the stay 160. Thus, the nip plate 130 and the reflection plate 140 are held to the stay 160.

Vertical displacement of the reflection plate 140 due to vibration caused by operation of the fixing device 100 can be restrained, since the flange portions 142 are held between the nip plate 130 and the stay 160 as shown in FIG. 2. Thus, position of the reflection plate 140 relative to the nip plate 130 can be fixed.

The widthwise (left and right) end portions of the stay 160 holding the nip plate 130 and the reflection plate 140, and the halogen lamp 120 are directly fixed to a pair of the guide members (not shown) made from resin. That is, the guide members integrally support the nip plate 130, the reflection plate 140, the stay 160, and the halogen lamp 120. Further, each of the guide members is constantly urged downward (toward the pressure roller 150) by a spring. With this configuration, preferable nip pressure can be applied to a portion between the nip plate 130 and the pressure roller 150 when a printing operation is performed.

<Structure of Upper Surface of Nip Plate>

Figure 5:
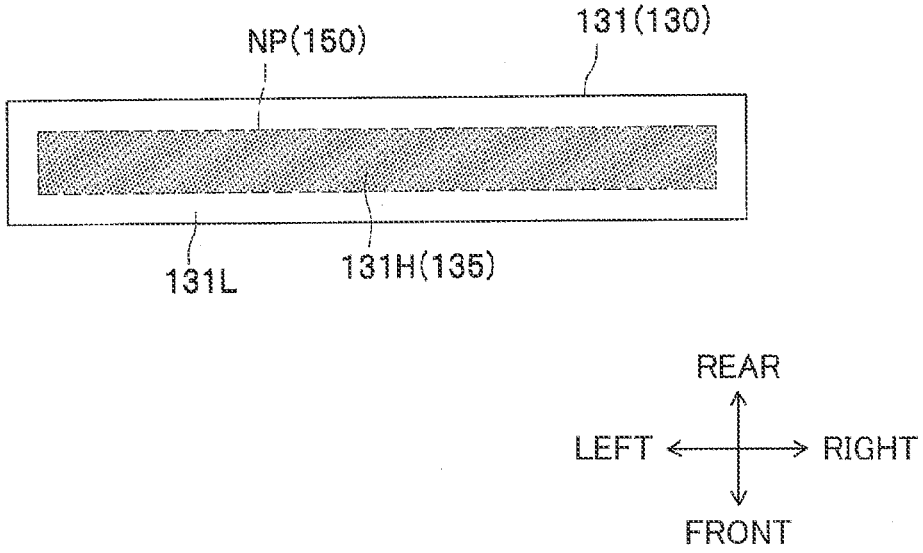
FIG. 5 is a plan view of the nip plate in which a position of a layer of paint is shown according to the first embodiment.

As shown in FIGS. 2, 3, and 5, the upper surface 131S of the nip plate 130 (base portion 131) has a region corresponding to (overlapping with) the nip region NP that is painted with a black color shown as the layer of paint 135. More specifically, the upper surface 131S of the nip plate 130 has a high absorption region 131H and a low absorption region 131L. The high absorption region 131H is positioned at the region of the upper surface 131S corresponding to the nip region NP provided with the layer of paint 135. The low absorption region 131L is positioned at a surrounding region of the upper surface 131S that surrounds the region of the upper surface 131S corresponding to the nip region NP. That is, the low absorption region 131L is positioned at a region of the upper surface 131S not painted with a black color. The high absorption region 131H tends to absorb radiant heat from the halogen lamp 120, while the low absorption region 131L tends to reflect radiant heat from the halogen lamp 120. The high absorption region 131H has a heat absorption ratio higher than that of the low absorption region 131L. The high absorption region 131H is positioned so as to be concentrated on the region of the upper surface 131S corresponding to the nip region NP.

Radiant heat that has not been absorbed in the low absorption region 131L is reflected by the reflection plate 140 (reflection portion 141) to the nip plate 130, and is mostly absorbed in the region of the upper surface 131S corresponding to the nip region NP. According to the first embodiment, heat generated by the halogen lamp 120 can be concentrated on the region of the upper surface 131S corresponding to the nip region NP. As a result, with regard to toner on the sheet P, toner heating efficiency can be improved.

In particular, as shown in FIGS. 2 and 5, the low absorption region 131L is disposed in front and rear end portions of the upper surface 131S in the frontward/rearward direction (sheet feeding direction). The reflection plate 140 contacts the front and rear end portions of the upper surface 131S, and the stay 160 is adjacent to the front and rear end portions of the upper surface 131S. The low absorption region 131L can prevent the reflection plate 140 and the stay 160 from being excessively heated by radiant heat from the upper surface 131S. Further, the low absorption region 131L is also disposed in left and right end portions of the upper surface 131S in the rightward/leftward direction (the axial direction). The guide members made of resin are fixed to left and right end portions of the nip plate 130. The low absorption region 131L can prevent the guide members from being melted by radiant heat from the upper surface 131S.

In FIGS. 2 and 5, the high absorption region 131H on which the layer of paint 135 is provided is substantially coincident with the region of the upper surface 131S corresponding to the nip region NP. However, various modifications on the shape, position, and size of the high absorption region 131H are conceivable to efficiently heat the region of the upper surface 131S corresponding to the nip region NP.

The high absorption region 131H may (1) extend to the front, rear, left, and right end portions of the upper surface 131S; (2) not necessarily cover the region of the upper surface 131S corresponding to the nip region NP entirely; (3) not necessarily be formed in a rectangular shape (i.e. not be similar in shape to the region of the upper surface 131S corresponding to the nip region NP); and (4) may be formed with a plurality of high absorption portions. Accordingly, change in positions of the high absorption region 131H and the low absorption region 131L enables a heat absorption distribution to be precisely adjusted.

Incidentally, if most of the high absorption region 131H (for example, greater than or equal to 50 percent of its dimension) is positioned at the region of the upper surface 131S corresponding to the nip region NP, it is advantageous to contribute to improvement of the heat efficiency of the nip region NP.

A fixing device 200 according to a second embodiment of the present invention will next be described while referring to FIGS. 6A to 7B wherein parts and components the same as those in the first embodiment are designated by the same reference numerals as those in the first embodiment to avoid duplicating description.

Figure 6A:
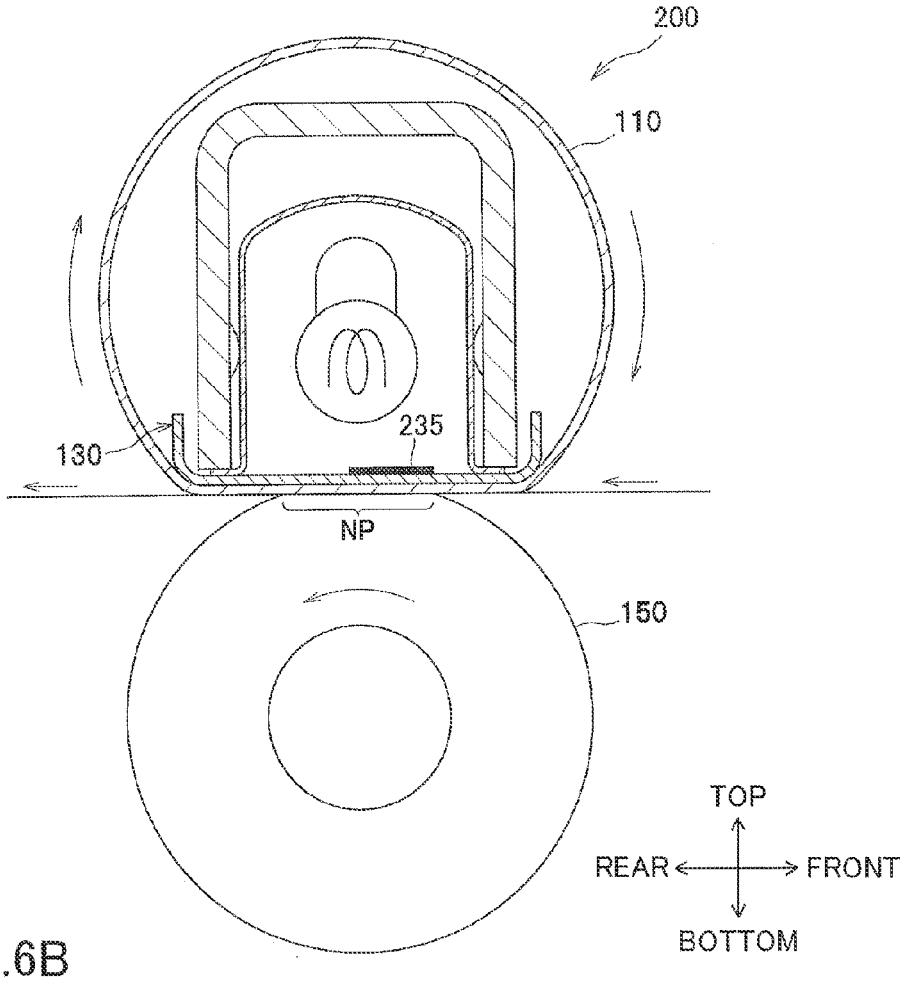
FIG. 6A is a schematic cross-sectional view of a fixing device according to a second embodiment of the present invention, in which a position of a layer of paint is shown.
Figure 6B:
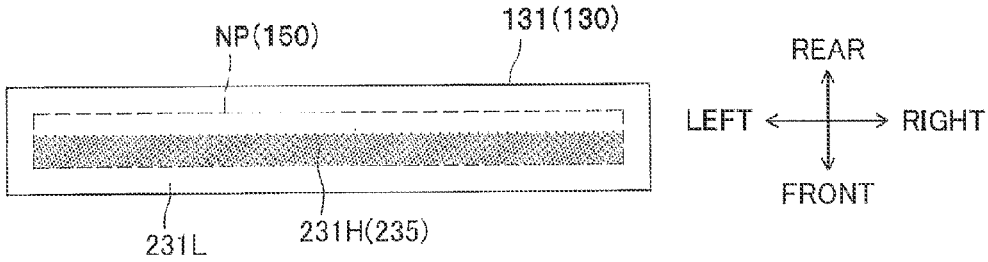
FIG. 6B is a plan view of the nip plate in which the position of the layer of paint is shown according to the second embodiment.

In the second embodiment, as shown in FIGS. 6A and 6B, the upper surface 131S has a high absorption region 231H and a low absorption region 231L. The high absorption region 231H is positioned at a front portion of the region of the upper surface 131S corresponding to the nip region NP in the frontward/rearward direction. The low absorption region 231L is positioned at a rear portion of the region of the upper surface 131S corresponding to the nip region NP in the frontward/rearward direction and at the surrounding region of the upper surface 131S. In the region of the upper surface 131S corresponding to the nip region NP, the high absorption region 131H is positioned upstream of the low absorption region 131L in the sheet feeding direction.

Figure 7A:
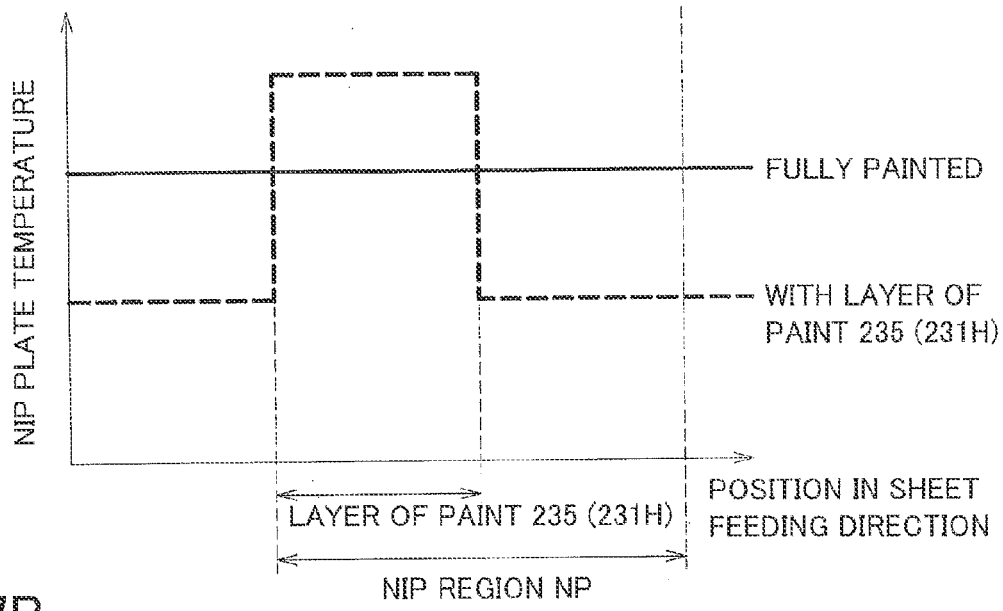
FIG. 7A is an explanatory view for explaining an operation of the fixing device according to the second embodiment, in which temperature distribution of a nip plate is shown.
Figure 7B:
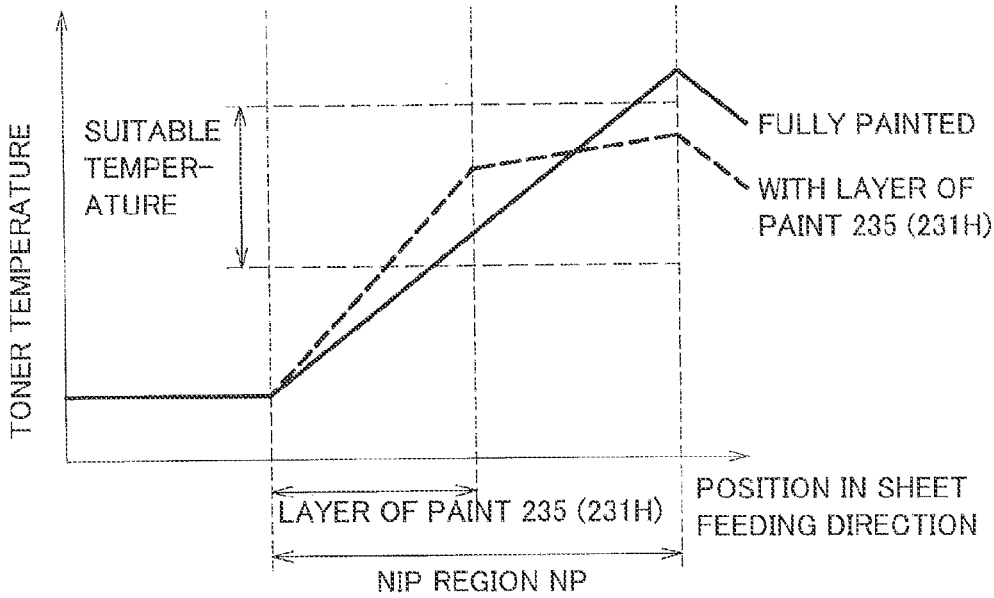
FIG. 7B is an explanatory view for explaining the operation of the fixing device according to the second embodiment, in which change in temperature of toner on a recording sheet conveyed in the fixing device is shown.

With this configuration, as schematically shown in FIGS. 7A and 7B, compared to a case where the upper surface 131S of the nip plate 130 is fully painted with a black color, toner can be promptly heated in the front (upstream) portion of the region of the upper surface 131S corresponding to the nip region NP. Thus, a temperature of toner can promptly reach a range of temperature suitable for thermally fixing (fusing) toner onto the sheet P. Accordingly, a time required for a toner fixing process can be reduced, thereby increasing a printing speed.

Here, the range of suitable temperature shown in FIG. 7B implies a range of temperature by which toner is fused to have a viscosity suitable for fixing. If the temperature of toner excesses the range of suitable temperature and becomes too high, the viscosity of toner decreases, and thereby generating a so-called hot offset phenomenon. If the temperature of toner falls below the range of suitable temperature and becomes too low, the viscosity of toner increases, and thereby generating a so-called cold offset phenomenon. In both cases, toner to be fixed onto the sheet P comes off the sheet P, and adheres to the fusing film 110.

The rear (downstream) portion of the region of the upper surface 131S corresponding to the nip region NP is not provided with a layer of paint 235, that is, a low absorption region 231L is positioned at the rear portion of the region of the upper surface 131S corresponding to the nip region NP. With this configuration, the temperature of toner becomes relatively low in the rear portion of the region of the upper surface 131S corresponding to the nip region NP. Hence, the rear portion of the region of the upper surface 131S can act so as to prevent excessive temperature elevation of toner. Accordingly, the low absorption region 231L positioned at the rear portion of the region of the upper surface 131S corresponding to the nip region NP can prevent the temperature of toner from exceeding the range of suitable temperature and becoming too high. That is, the low absorption region 231L can prevent occurrence of hot offset. Further, the low absorption region 231L positioned at the rear portion of the region of the upper surface 131S corresponding to the nip region NP can lengthen a time maintaining toner within the range of suitable temperature. That is, the low absorption region 231L can prevent occurrence of cold offset. Accordingly, toner fixing quality can be improved.

The first and second embodiments of the present invention have been described above, various modifications are conceivable. For example, as shown in FIG. 8A, a layer of paint 335 (i.e. a high absorption region 331H) is positioned at the region of the upper surface 131S corresponding to the nip region NP. More specifically, the high absorption region 331H is provided so as to have lengths in the frontward/rearward direction (the sheet feeding direction) that differ in position of the nip plate 130 in the rightward/leftward direction (the axial direction). Further, as shown in FIG. 8B, a layer of paint 435 (i.e. a high absorption region 431H) is positioned at the region of the upper surface 131S corresponding to the nip region NP. More specifically, the high absorption region 431H is provided so as to have lengths in the frontward/rearward direction (the sheet feeding direction) that differ in position of the nip plate 130 in the rightward/leftward direction (the axial direction).

In such a case that the widthwise (right and left) end portions of the halogen lamp 120 have a too high amount of heat due to a design error in a heat distribution, as shown in FIG. 8A, the layer of paint 335 (the high absorption region 331H) is positioned and distributed in the region of the upper surface 131S corresponding to the nip region NP so as to have right and left end portions and a central portion in the rightward/leftward direction (the axial direction), and the central portion has a length greater than that of the end portions in the frontward/rearward direction (the sheet feeding direction). With this configuration, a temperature of the nip region NP can be adjusted such that the widthwise (left and right) end portions of the nip region NP has a temperature not too high.

In contrast to the above, in such a case that a central portion of the halogen lamp 120 has a too high amount of heat due to a design error in a heat distribution, as shown in FIG. 8B, the layer of paint 435 (the high absorption region 431H) is positioned and distributed in the region of the upper surface 131S corresponding to the nip region NP so as to have right and left end portions and a central portion in the rightward/leftward direction (the axial direction), and the right and left end portions have a length greater than that of the central portion in the frontward/rearward direction (the sheet feeding direction). With this configuration, heat absorption in a central portion of the nip region NP can be restrained, and a temperature of the nip region NP can be adjusted such that the central portion of the nip region NP has a temperature not too high.

That is, the heat distribution of the nip plate 130 in the rightward/leftward direction can be easily changed by changing the position of the layer of paint. In the modifications shown in FIGS. 8A and 8B, the high absorption regions 331H and 431H are positioned at the region of the upper surface 131S corresponding to the nip region NP. Accordingly, advantages and effects the same as those in the first embodiment, that is, improvement of heat efficiency in the nip region NP can be realized.

Adjustment of the heat absorption ratio of the nip plate 130 in the rightward/leftward direction can be also realized by changing a color (density) of the layer of paint 135. That is, the heat absorption ratio of the nip plate 130 in the rightward/leftward direction can be adjusted by positioning the high absorption region 131H so as to have different heat absorption ratios in different position of the nip plate 130 in the rightward/leftward direction (the axial direction).

For example, as shown in FIG. 8C, the region of the upper surface 131S corresponding to the nip region NP has a first high absorption region 531HA and second high absorption regions 531HB. The first high absorption region 531HA is positioned at the central portion of the region of the upper surface 131S corresponding to the nip region NP and painted with a black color or a dark color. The second high absorption regions 531HB are positioned at the right and left end portions of the region of the upper surface 131S corresponding to the nip region NP and painted with a color paler than the color painted in the first high absorption region 531HA. A low absorption region 531L is positioned at the surrounding region of the upper surface 131S. Hence, the left and right end portions of the region of the upper surface 131S corresponding to the nip region NP in the rightward/leftward direction (the axial direction) has a heat absorption ratio higher than that of the surrounding region of the upper surface 131S but lower than that of the central portion of the region of the upper surface 131S corresponding to the nip region NP.

With this configuration, the first high absorption region 531HA and second high absorption region 531HB can be positioned so that the central portion of the region of the upper surface 131S corresponding to the nip region NP has a heat absorption ratio higher than that of the left and right end portions of the region corresponding to the nip region NP. For example, in a case where the right and left end portions of the halogen lamp 120 have a too high amount of heat due to a design error in a heat distribution, a temperature of the nip region NP can be adjusted with this configuration such that the left and right end portions of the nip region NP has a temperature not too high.

Further, as shown in FIG. 8D, the region of the upper surface 131S corresponding to the nip region NP has first high absorption regions 631HA and a second high absorption region 631HB. The first high absorption regions 631HA are positioned at the right and left end portions of the region of the upper surface 131S corresponding to the nip region NP and painted with a black color or a dark color. The second high absorption region 631HB is positioned at the central portion of the region of the upper surface 131S corresponding to the nip region NP and painted with a color paler than the color painted in the first high absorption regions 631HA. A low absorption region 631L is positioned at the surrounding region of the upper surface 131S. Hence, the left and right end portions of the region of the upper surface 131S corresponding to the nip region NP in the rightward/leftward direction (the axial direction) has a heat absorption ratio higher than that of the surrounding region of the upper surface 131S and also higher than that of the central portion of the region of the upper surface 131S corresponding to the nip region NP.

With this configuration, the first high absorption region 631HA and the second high absorption region 631HB can be positioned so that the right and left end portions of the region of the upper surface 131S corresponding to the nip region NP have a heat absorption ratio higher than that of the central portion of the region of the upper surface 131S corresponding to the nip region NP. For example, in a case where the central portion of the halogen lamp 120 has a too high amount of heat due to a design error in a heat distribution, heat absorption in the central portion of the nip region NP can be restrained, and a temperature of the nip region NP can be adjusted with this configuration such that the central portion of the nip region NP has a temperature not too high.

In the modifications shown in FIGS. 8C and 8D, the first high absorption regions 531HA and 631HA and the second high absorption regions 531HB and 631HB are positioned at the region of the upper surface 131S corresponding to the nip region NP. Accordingly, advantages and effects the same as those in the first embodiment, that is, improvement of heat efficiency in the nip region NP can be realized. In addition, a heat absorption ratio in each of the first and second high absorption regions can be easily adjusted by painting the region of the upper surface 131S corresponding to the nip region NP with different colors (different densities).

Incidentally, in FIGS. 8C and 8D, two different colors, a dark color and a pale color, are painted at the region of the upper surface 131S corresponding to the nip region NP. However, if necessary, equal to or more than three different colors can be painted at the region of the upper surface 131S corresponding to the nip region NP. Alternatively, colors gradually changing from dark to pale can be painted at the region of the upper surface 131S corresponding to the nip region NP. With this configuration, precise adjustment of the temperature of the nip plate 130 can be attained. Therefore, the temperature of toner can be more accurately controlled.

In FIG. 8E, a high absorption region 731H protrudes from the region of the upper surface 131S corresponding to the nip region NP, and a low absorption region 731L is positioned at the left, right, rear end portions of the upper surface 131S. In this case, the high absorption region 731H is positioned at the region of the upper surface 131S corresponding to the nip region NP, compared to the low absorption region 731L. Hence, the region of the upper surface 131S corresponding to the nip region NP can be efficiently and intensively heated by the high absorption region 731H.

Further, in the modification shown in FIG. 8E, the front end portion of the upper surface 131S and the region of the upper surface 131S corresponding to the nip region NP constitute the high absorption region 731H. The front end portion of the upper surface 131S is positioned upstream of the region of the upper surface 131S corresponding to the nip region NP in the sheet feeding direction. With this configuration, before the fusing film 110 enters into the nip region NP, the fusing film 110 can be rapidly heated by the high absorption region 731H positioned at the front end portion of the upper surface 131S. Hence, the temperature of toner can promptly reach the range of suitable temperature.

Figure 9A:
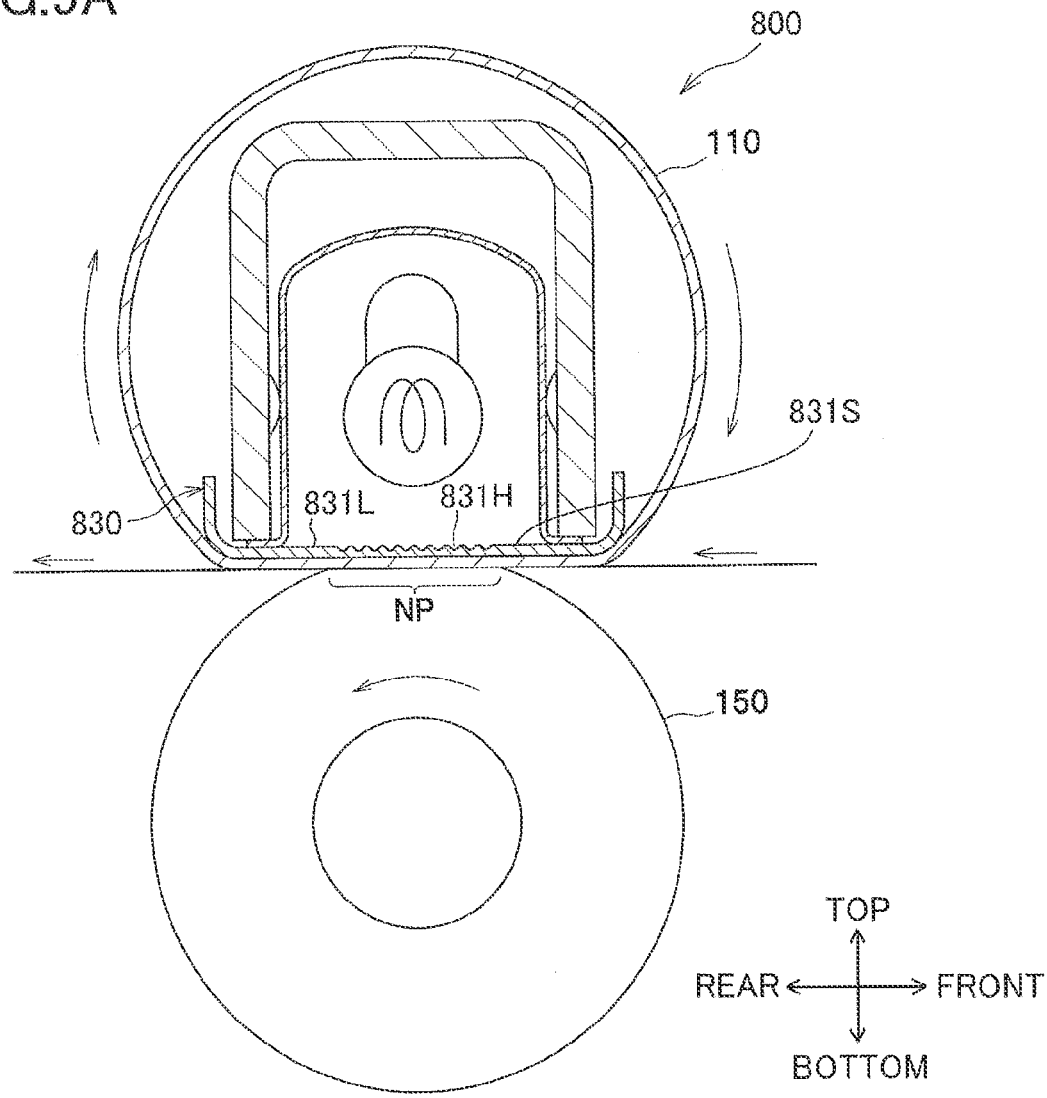
FIG. 9A is a schematic cross-sectional view of a fixing device according to a third embodiment of the present invention, in which a nip plate having an irregular surface is provided.
Figure 9B:
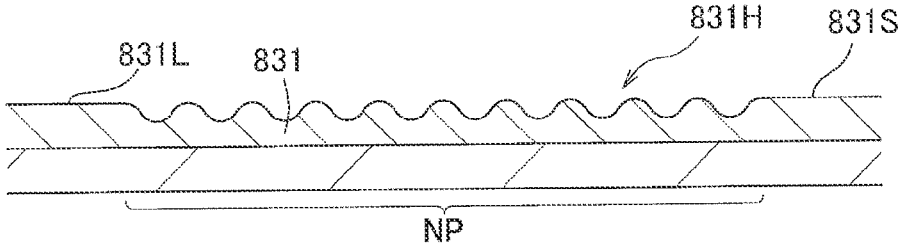
FIG. 9B is a schematic enlarged cross-sectional view of the nip plate and a fusing film shown in FIG. 9A.

A fixing device 800 according to a third embodiment of the present invention will next be described while referring to FIGS. 9A and 9B. In the first and second embodiments, the high absorption region is defined such that a part of the upper surface 131S is painted with a black color or a color darker than a color of remaining part of the upper surface 131S. However, as shown in FIGS. 9A and 9B, the upper surface 831S of the nip plate 830 can be formed with an irregular surface to define a high absorption region 831H. The upper surface 831S has a low absorption region 831L positioned at a flat surface of the upper surface 831S other than the irregular surface, and the low absorption region 831L has a predetermined heat absorption ratio. The high absorption region 831H has a heat absorption ratio higher than that of the low absorption region 831L. The irregular surface has a surface area greater than that of the flat surface, and thus, the heat absorption ratio of the irregular surface is higher than that of the flat region.

In the third embodiment shown in FIGS. 9A and 9B, modifications of the position, dimension, and plane shape of the irregular surface as the high absorption region 831H are conceivable. Change in depth and/or roughness of the irregular shape can change the heat absorption ratio of the high absorption region 831H. Thus, precise adjustment of distribution of the heat absorption ratio depicted in the above embodiments is also available.

Further, it is not necessary to directly paint or irregularly configure the upper surface 131S of the nip plate 130 to define the high absorption region. A heat absorption member having a heat absorption ratio higher than that of the nip plate 130 can be fixed onto the upper surface 131S of the nip plate 130.

The above described embodiments and modifications can be applied in combination.

Further, in the depicted embodiments, the fixing device includes the reflection plate 140 and the stay 160. However, the reflection plate 140 or the stay 160 can be dispensed with.

Further, in the depicted embodiments, an infrared ray heater or a carbon heater is available instead of the halogen lamp 120 (halogen heater).

Further, in the depicted embodiments, the nip plate 130 is employed as a nip member. However, a thick non-planar member is also available.

Further, in the depicted embodiments, the pressure roller 150 is employed as a backup member. However, a belt like pressure member is also available.

Further, in the depicted embodiments, the nip region NP is provided by the pressure contact of the nip plate 130 (nip member) against the pressure roller 150 (backup member). However, the nip region NP can also be provided by a pressure contact of the backup member against the nip member.

Further, the sheet P can be an OHP sheet instead of plain paper and a postcard.

Further, in the depicted embodiments, the image forming device is the monochromatic laser printer. However, a color laser printer, an LED printer, a copying machine, and a multifunction device are also available.

While the invention has been described in detail with reference to the embodiment thereof, it would be apparent to those skilled in the art that various changes and modifications may be made therein without departing from the spirit of the invention.

What is claimed is:

1. A fixing device for thermally fixing a developing agent image to a sheet fed in a sheet feeding direction comprising:

a tubular flexible fusing member having an inner peripheral surface defining an internal space and defining an axial direction;

a heater disposed in the internal space and configured to radiate radiant heat;

a nip member disposed in the internal space and configured to receive the radiant heat from the heater, the inner peripheral surface being in sliding contact with the nip member, the nip member having an upstream end portion and a downstream end portion in the sheet feeding direction;

a backup member configured to provide a nip region in cooperation with the fusing member upon nipping the fusing member between the backup member and the nip member;

a reflection member disposed to surround the heater and configured to reflect the radiant heat toward the nip member; and a stay disposed to cover the reflection member and configured to support the upstream and downstream end portions of the nip member at a first supporting location and a second supporting location, respectively, wherein the nip member has a surface confronting the heater, the surface including a first heat absorption region having a first heat absorption ratio of a predetermined value and a second heat absorption region having a second heat absorption ratio higher than the first heat absorption ratio, the second heat absorption region being positioned at a region of the surface overlapping with the nip region, wherein the first heat absorption region and the second heat absorption region define a major boundary therebetween, the major boundary extending generally in the axial direction and spaced a first distance from each of the first supporting location and the second supporting location, and wherein the surface of the nip member has upstream and downstream end portions in the sheet feeding direction at which a part of the first heat absorption region is positioned.

2. The fixing device as claimed in claim 1, wherein the surface of the nip member has end portions in the axial direction at which a part of the first heat absorption region is positioned.

3. The fixing device as claimed in claim 1, wherein the first heat absorption region and the second heat absorption region are positioned at the region of the surface overlapping with the nip region, the first heat absorption region being disposed at downstream of the second heat absorption region in the sheet feeding direction.

4. The fixing device as claimed in claim 1, wherein the second heat absorption region has different lengths in the sheet feeding direction in different positions in the axial direction.

5. The fixing device as claimed in claim 4, wherein the second heat absorption region is distributed in the surface of the nip member so as to have a central portion and end portions in the axial direction, the end portions having a length greater than that of the central portion in the sheet feeding direction.

6. The fixing device as claimed in claim 4, wherein the second heat absorption region is distributed in the surface of the nip member so as to have a central portion and end portions in the axial direction, the central portion having a length greater than that of the end portions in the sheet feeding direction.

7. The fixing device as claimed in claim 1, wherein the second heat absorption region has different heat absorption ratios in different positions in the axial direction.

8. The fixing device as claimed in claim 7, wherein the second heat absorption region has a central portion and end portions in the axial direction, the end portions having a heat absorption ratio higher than that of the central portion.

9. The fixing device as claimed in claim 7, wherein the second heat absorption region has a central portion and end portions in the axial direction, the central portion having a heat absorption ratio higher than that of the end portions.

10. The fixing device as claimed in claim 1, wherein the second heat absorption region is formed with an irregular surface.

* * * * *